US007462989B2

(12) United States Patent
Hasegawa et al.

(10) Patent No.: US 7,462,989 B2
(45) Date of Patent: Dec. 9, 2008

(54) PLASMA DISPLAY PANEL, METHOD FOR PRODUCING SAME AND MATERIAL FOR PROTECTIVE LAYER OF SUCH PLASMA DISPLAY PANEL

(75) Inventors: Kazuyuki Hasegawa, Osaka (JP); Yoshinao Oe, Kyoto (JP); Kaname Mizokami, Osaka (JP); Hirokazu Nakaue, Osaka (JP); Hiroyuki Kado, Osaka (JP)

(73) Assignee: Panasonic Corporation, Osaka (JP)

( * ) Notice: Subject to any disclaimer, the term of this patent is extended or adjusted under 35 U.S.C. 154(b) by 572 days.

(21) Appl. No.: 10/520,905

(22) PCT Filed: May 14, 2004

(86) PCT No.: PCT/JP2004/006876

§ 371 (c)(1),
(2), (4) Date: Jan. 11, 2005

(87) PCT Pub. No.: WO2004/102605

PCT Pub. Date: Nov. 25, 2004

(65) Prior Publication Data

US 2005/0258753 A1 Nov. 24, 2005

(30) Foreign Application Priority Data

May 19, 2003 (JP) ..... 2003-140166

(51) Int. Cl.
*H01J 17/49* (2006.01)

(52) U.S. Cl. ..... 313/586; 313/582

(58) Field of Classification Search ..... 313/582–587; 315/169.4; 345/37, 41, 60, 71
See application file for complete search history.

(56) References Cited

U.S. PATENT DOCUMENTS

| | | | | |
|---|---|---|---|---|
| 3,976,823 | A * | 8/1976 | Ernsthausen | 313/587 |
| 6,037,713 | A * | 3/2000 | Fukuta et al. | 313/582 |
| 6,229,582 | B1 * | 5/2001 | Van Slooten | 313/582 |

FOREIGN PATENT DOCUMENTS

| | | |
|---|---|---|
| JP | 10-334809 | 2/1998 |
| JP | 10-141348 | 12/1998 |
| JP | 11-54048 | 2/1999 |
| JP | 11-334809 | 2/1999 |
| JP | 2003-100217 A | 4/2003 |

* cited by examiner

*Primary Examiner*—Nimeshkumar D Patel
*Assistant Examiner*—Christopher M Raabe
(74) *Attorney, Agent, or Firm*—McDermott Will & Emery LLP

(57) ABSTRACT

A plasma display panel (PDP) includes front plate, scan electrodes and sustain electrodes both formed on front plate, dielectric layer covering scan and sustain electrodes, and protective layer formed on dielectric layer. Protective layer contains silicon (Si) and nitrogen (N), and is made of magnesium oxide (MgO) including Si of which atoms count in the range from $5\times10^{18}$ pieces/cm$^3$ to $8\times10^{21}$ pieces/cm$^3$. The foregoing construction allows the PDP to shorten a discharge-delay time, achieve a quick response of discharge to a voltage applied, and suppress changes of the discharge-delay time with respect to a temperature.

5 Claims, 3 Drawing Sheets

PLASMA DISPLAY PANEL, METHOD FOR PRODUCING SAME AND MATERIAL FOR PROTECTIVE LAYER OF SUCH PLASMA DISPLAY PANEL

THIS APPLICATION IS A U.S. NATIONAL PHASE APPLICATION OF PCT INTERNATIONAL APPLICATION PCT/JP2004/006876

TECHNICAL FIELD

The present invention relates to a plasma display panel (PDP) to be used in a video display device, a method of manufacturing the PDP, and material of a protective layer of the PDP.

BACKGROUND ART

A plasma display panel, adopting an AC surface-discharge method, comprises a front plate having plural display electrodes formed of scan electrodes and sustain electrodes, a back plate having plural address electrodes placed to intersect with the display electrodes at right angles. The front plate confronts the back plates such that a discharge space is formed in between, and the circumference of those two plates is sealed together. The discharge space is filled with discharge gas such as neon and xenon. The display electrodes are covered with a dielectric layer, and on top of that a protective layer is formed. The protective layer is generally made of highly resistive material, such as magnesium oxide (MgO), against sputtering for protecting the dielectric layer from ion-impact generated by discharge. Respective display electrodes form one line, and discharge cells are formed at intersections of the display electrodes and the address electrodes.

In the PDP discussed above, one field (1/60 seconds) of a video signal is formed of plural sub-fields having weighting of luminance, every sub-field has an address period and a sustain period. During the address period, data is addressed by generating address-discharge at a discharge cell which is to be lighted with each one of lines scanned sequentially. During the sustain period, discharges are initiated the number of times corresponding to the weighting of luminance at the discharge cell, to which data has been addressed during the address period, so that the cell is lit.

In the case of displaying a video of television broadcasting, all the operations of respective sub-fields should be completed within one field. Since the discharge cells are more densely populated on a screen recently, the number of scanning lines increases, so that address-discharge at each line should be done within a shorter period. In other words, during the address period, a pulse having a narrower width is applied to scan electrodes and address electrodes in order to generate address-discharge, so that a high speed driving should be carried out. However, since the discharge takes place with a delay from a rise of a pulse, i.e. there is a discharge-delay, the probability of completing a discharge during a pulse application becomes lower. Therefore, data cannot be addressed to discharge cells to be lit, so that a lighting defect sometimes occurs, which results in lowering the display quality.

A principal factor causing the foregoing discharge delay can be this: an initial electron working as a trigger at starting discharge becomes resistant to emission from the protective layer to the discharge space. The protective layer thus becomes a target of study for improving the display quality.

An improvement of electron emission from a protective layer is disclosed in Japanese Patent Application Non-Examined Publication No. H10-334809, namely, silicon is added to a protective layer made of MgO, so that an emission amount of secondary electrons increases for improving the display quality.

However, the protective layer made of MgO and Si substantially changes its capacity of emitting electrons depending on its temperature, so that the discharge-delay time also greatly changes. As a result, an ambient temperature of a PDP actually changes the display quality.

DISCLOSURE OF INVENTION

The present invention addresses the problem discussed above, and aims to shorten a discharge-delay time for achieving a quick response of discharge to a voltage applied as well as suppress a change in discharge-delay time with respect to an ambient temperature.

A plasma display panel (PDP) of the present invention comprises the following elements:

- a dielectric layer formed such that it covers scan electrodes and sustain electrodes formed on a plate; and
- a protective layer formed on the dielectric layer and including silicon (Si) and nitrogen (N).

A method of manufacturing the PDPs of the present invention comprises the steps of:

- forming a dielectric layer to cover scan electrodes and sustain electrodes formed on a plate; and
- forming a protective layer on the dielectric layer.

The step of forming a protective layer uses material including silicon and nitrogen for the protective layer, and a process for forming a film takes place in this step.

The material for the protective layer of the PDP of the present invention includes Si and N, and the protective layer is formed on the dielectric layer which covers the scan electrodes as well as sustain electrodes both formed on the plate.

DETAILED DESCRIPTION OF PREFERRED EMBODIMENTS

Exemplary embodiments of the present invention are demonstrated hereinafter with reference to the accompanying drawings.

Exemplary Embodiment 1

Figure 1:
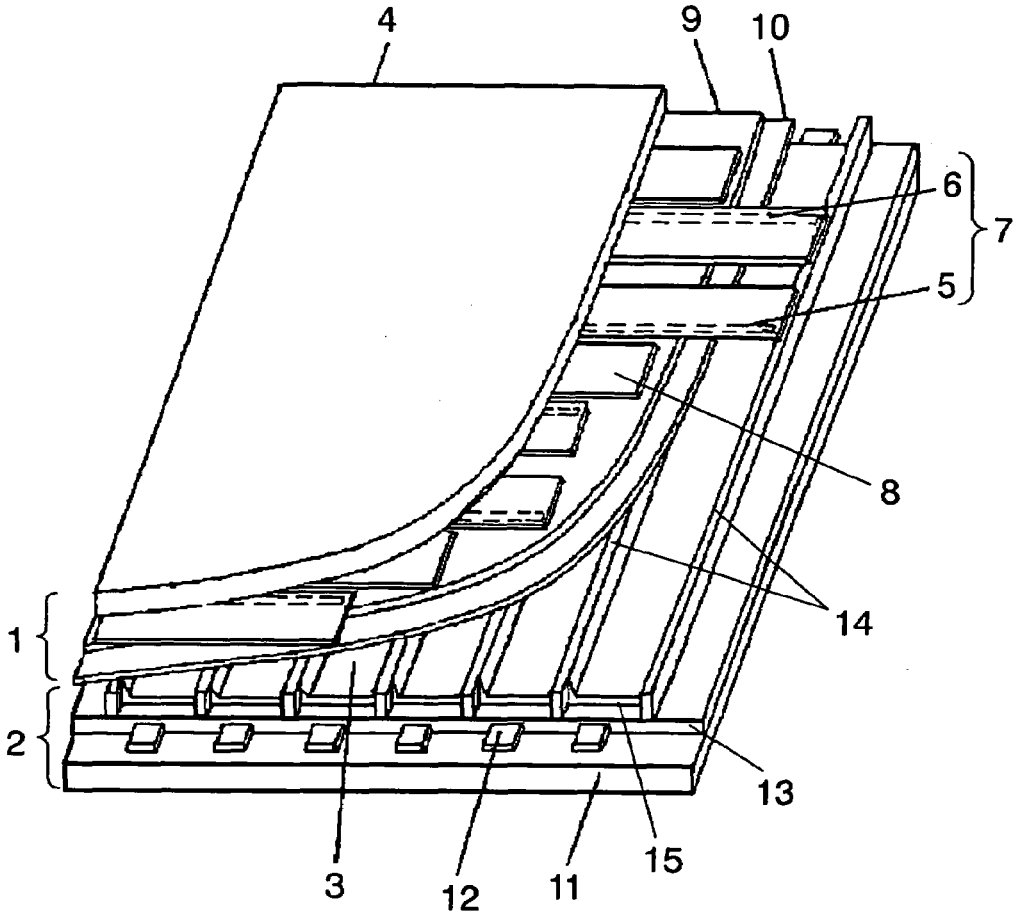
FIG. 1 shows a perspective view illustrating parts of a PDP in accordance with a first exemplary embodiment of the present invention.

FIG. 1 shows a perspective partially cutaway view illustrating a PDP adopting an. AC surface discharge method. This PDP includes front panel 1 and back panel 2 opposed to each other, discharge space 3 formed in between of panel 1 and panel 2, and dischargeable gas formed of neon and xenon filled in the discharge space.

Front panel 1 comprises the following elements:

front plate 4 made of glass;

plural display electrodes 7 formed of striped scan electrodes 5 and striped sustain electrodes 6 formed on front plate 4;

light blocking layers 8 disposed between the display electrodes adjacent to each other;

dielectric layer 9 covering display electrodes 7 and light blocking layers 8; and protective layer 10 made of magnesium oxide (MgO) which contains silicon (Si) and nitrogen (N), and covering the surface of dielectric layer 9.

Back panel 2 comprises the following elements:

back plate 11 made of glass;

plural address electrodes 12 arranged such that they form a striped pattern and intersect with scan electrodes 5 and sustain electrodes 6 at right angles respectively;

electrode protective layer 13 covering address electrodes 12;

barrier ribs 14, arranged in parallel with and between address electrodes 12, disposed on electrode protective layer 13; and phosphor layer 15 between barrier ribs 14.

Electrode protective layer 13 protects address electrodes 12 and reflects visible light generated by phosphor layer 15 to front panel 1.

Display electrodes 7 form one line respectively, and discharge cells are formed at intersections of display electrodes 7 and address electrodes 12. A discharge takes place at discharge space 3 of respective discharge cells, and the discharge generates three visible colors, i.e. red, green and blue, from phosphor layer 15, and those visible lights in three colors travels through front panel 1, thereby displaying a video.

Figure 2:
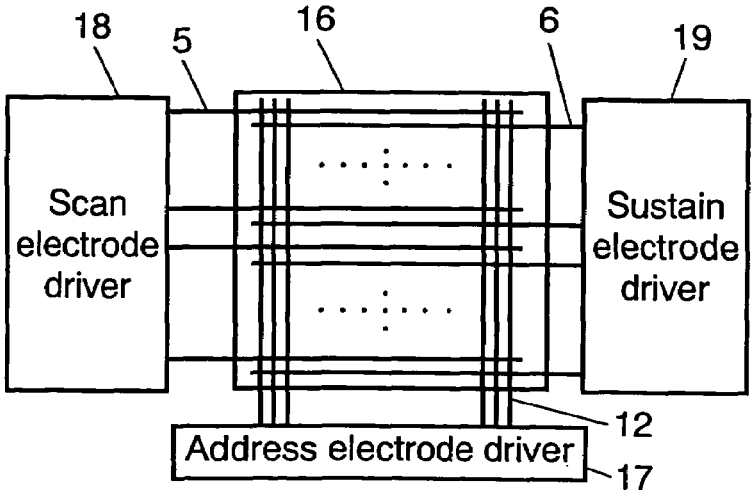
FIG. 2 shows a block diagram illustrating a video display device employing the PDP shown in FIG. 1.

FIG. 2 shows a block diagram illustrating a video display device employing the PDP shown in FIG. 1. As shown in FIG. 2, address electrode 12 of PDP 16 is coupled to address-electrode driver 17, scan electrode 5 is coupled to scan-electrode driver 18, and sustain electrode 6 is coupled to sustain-electrode driver 19.

Figure 3:
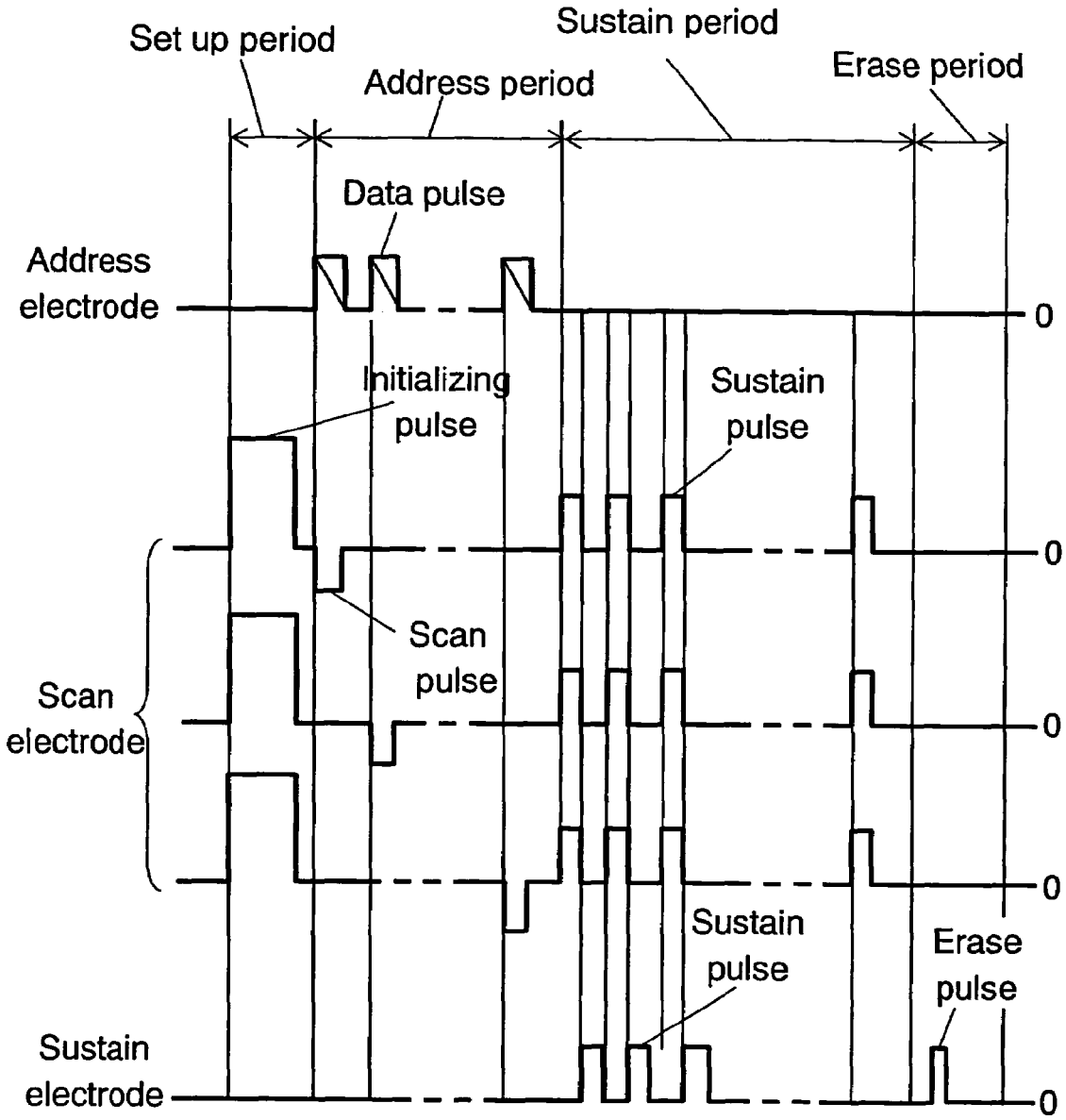
FIG. 3 shows a timing-chart illustrating a driving waveform of the PDP.

FIG. 3 shows a timing chart illustrating a driving waveform of the PDP. In general, a PDP adopting an AC surface discharge method displays a gray scale by dividing a video of one field into plural sub-fields. In order to control the discharge of each one of the discharge cells, one sub-field is formed of four periods, i.e. set-up period, address period, sustain period and erase period. The timing chart shown in FIG. 3 shows a driving waveform within one sub-field discussed above.

In FIG. 3, during the set-up period, wall charges accumulate uniformly in all the discharge cells within the PDP so that discharge can take place with ease. During the address period, address discharge takes place in discharge cells to be lit. During the sustain period, the discharge cells in which an address discharge has taken place are lit and the lighting is sustained. During the erase period, the wall charges are erased, so that the lighting is halted.

During the set-up period, an initializing pulse is applied to scan electrode 5, so that a voltage higher than that applied to address electrode 12 or sustain electrode 6 is applied to scan electrode 5, thereby generating a discharge in discharge cells. Electric charges generated by this discharge accumulate on walls of the discharge cells such that the electric charges cancel potential differences between address electrode 12, scan electrode 5 and sustain electrode 6. As a result, negative charges accumulate as wall charges on a surface of protective layer 10 around scan electrode 5. On the other hand, positive charges accumulate as wall charges on a surface of phosphor layer 15 around address electrode 12 as well as on a surface of protective layer 10 around sustain electrode 6. Those wall charges produce a given wall potential between scan electrode 5 and address electrode 12, scan electrode 5 and sustain electrode 6.

During the address period, in the case of lighting a discharge cell, a scan pulse is applied to scan electrode 5, and a data pulse is applied to address electrode 12. However, a voltage applied to scan electrode 5 is lower than those applied to address electrode 12 and sustain electrode 6. To be more specific, a voltage in the same direction as the wall charges is applied between scan electrode 5 and address electrode 12, and at the same time a voltage in the same direction as the wall charges is applied between scan electrode 5 and sustain electrode 6, so that the address discharge takes place. As a result, negative charges accumulate on the surface of phosphor layer 15 and the surface of protective layer 10 around sustain electrode 6, and positive charges accumulate as wall charges on the surface of protective layer 10 around scan electrode 5. Those charges accumulated produce a given wall potential between sustain electrode 6 and scan electrode 5.

During the sustain period, a sustain pulse is applied to scan electrode 5 first of all, so that a voltage higher than that applied to sustain electrode 6 is applied to scan electrode 5. In other words, a voltage in the same direction as the wall potential is applied between sustain electrode 6 and scan electrode 5, thereby generating a sustain discharge. As a result, discharge cells start lighting. Then sustain pulses are applied such that the polarities between sustain electrode 6 and scan electrode 5 alternate with each other, so that the discharge cells light intermittently.

During the erase period, an application of an erase pulse having a narrow width to sustain electrode 6 generates an incomplete discharge, so that the wall charges are eliminated. As a result, erase is carried out.

The discharge-delay time in the address period is defined as a time span from when a voltage for address-discharge is applied between scan electrode 5 and address electrode 12 to when the address-discharge takes place. If this discharge-delay prevents the address discharge from taking place during an application of the voltage (address time) between scan electrode 5 and address electrode 12, an address-miss occurs and no sustain voltage is generated, which results in flicker effects on the display. If a display device employs a display panel having a higher resolution, an address period allotted to respective scan electrodes 5 becomes shorter, so that the probability of address-miss becomes higher.

The PDP in accordance with the first embodiment features in the material of protective layer 10. Forming of the protective layer by the evaporation method is demonstrated hereinafter.

A device used in the evaporation method of forming protective layer 10 generally includes a preparation room, heating room, evaporating room, and cooling room. A plate is transferred in the device through those rooms in this order, so that protective layer 10 made of MgO is formed by evaporation. In this case, the embodiment uses evaporation material made of MgO containing Si and N, and this evaporation source is heated and evaporated by a pierce electron-beam gun in oxygen atmosphere. The evaporated material forms a film on the plate, i.e. undergoes a process for forming a film, thereby forming protective layer 10. In this process for forming a film, a current volume of the electron beam, a partial oxygen pressure, and a plate temperature can be set at any values. The following values are an instance of conditions for forming a film:

ultimate pressure (degree of vacuum): not higher than $5.0\times 10^{-4}$ Pa plate temperature at evaporation: not lower than 200° C.

pressure at evaporation: $3.0\times10^{-2}$Pa–$8.0\times10^{-2}$Pa

An MgO-sintered body and powder of silicon nitride ($Si_3N_4$) are mixed together as the material of protective layer, then this material is sintered for evaporation. A concentration of $Si_3N_4$ to be mixed is varied in the range of 0-20000 weight ppm, so that plural evaporation materials are prepared. Plural protective layers 10 are formed using respective those materials, and plural plates having those layers 10 respectively are prepared. Then PDPs employing those plates respectively are produced.

Those layers 10 of each PDP are analyzed by the secondary ion mass spectrometry (SIMS) for finding a concentration of Si and N contained in each one of layers 10. At this time, MgO film in which Si or N is implanted by the ion implantation is used as a standard sample for converting the concentration found by the SIMS of Si or N in layer 10 into the number of atoms per unit volume.

In the ambient temperature of −5° C.-+80° C., a discharge-delay time of each PDP is measured, and Arrhenus plot of the discharge delay time to the temperature is drawn using the measurement. Then activation energy of the discharge delay time is found from the approximate straight line to the plot.

The discharge-delay time here is defined as a time span from when a voltage is applied between scan electrode 5 and address electrode 12 to when the address-discharge takes place. Each one of the PDPs is observed with an address discharge occurring, and at the moment when an intensity of light emission due to the address discharge shows its peak, it is determined that a discharge takes place. The light emissions due to the address discharge in 100 times are averaged, so that the discharge-delay time is measured.

The activation energy is a value indicating a change in characteristics (discharge-delay time in this embodiment) with respect to a temperature, and as the value becomes lower, the characteristics become strongly resistant to a change with respect to a temperature.

Figure 4:
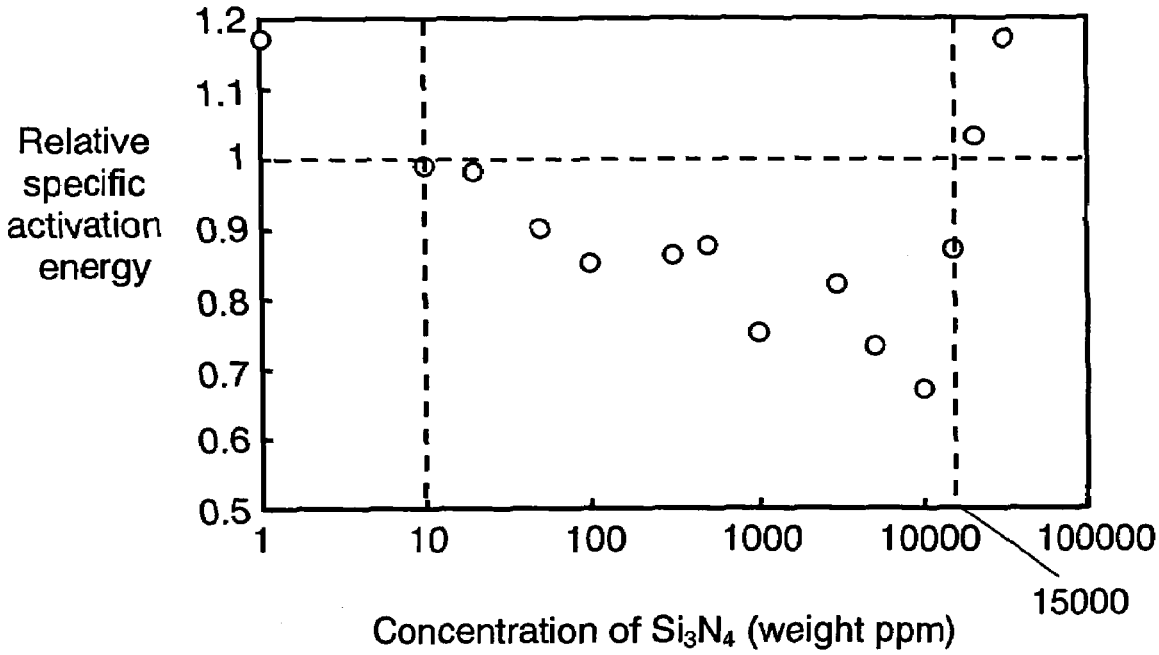
FIG. 4 shows characteristics of activation energy to be generated during a discharge-delay time of the PDP shown in FIG. 1.

The activation energy thus obtained is shown in FIG. 4. Evaporation material made of an MgO-sintered body to which only Si of 300 weight ppm is added is used for forming a protective layer of a PDP, and this PDP is used as a conventional PDP in FIG. 4. The activation energy generated during a discharge-delay time of this PDP is marked with numeral "1" in FIG. 4. The activation energy value of an MgO-sintered body with only Si added stays almost constant regardless of the concentration of Si added.

As shown in FIG. 4, a concentration not lower than 10 weight ppm of $Si_3N_4$ added to the evaporation source reduces the activation energy value comparing with the conventional case, i.e. only Si is added. However, a concentration over 15000 weight ppm of $Si_3N_4$ added elongates a discharge-delay time or increases extraordinarily a voltage necessary for a discharge, so that a video cannot be displayed at a voltage conventionally set. In other words, use of evaporation source made of MgO with $Si_3N_4$ added at a concentration ranged from 10-15000 weight ppm allows the PDP to display a video without changing a voltage conventionally set. The use of the foregoing evaporation source for protective layer 10 also obtains excellent electron-emission capacity of the PDP as well as lowers dependence of the discharge-delay time on a temperature.

In protective layer 10 formed by using the evaporation source made of MgO with $Si_3N_4$ added at a concentration ranged from 10-15000 weight ppm, the concentration of Si falls within a range approx. from $5\times10^{18}$ pieces/cm$^3$ to $2\times10^{21}$ pieces/cm$^3$. On the other hand, the concentration of N falls within a range approx. from $1\times10^{18}$ pieces/cm$^3$ to $8\times10^{21}$ pieces/cm$^3$. Meanwhile, in a protective layer of the conventional PDP, the concentration of Si is approx. $1\times10^{20}$ pieces/cm$^3$.

Inclusion of Si and N in protective layer 10 of a PDP thus allows the PDP to be independent of the temperature of the PDP itself, have a shorter discharge-delay time, be excellent in quick response, and thus display a quality video.

It is preferable to use protective layer 10 made of MgO that contains Si having the number of atoms ranging from $5\times10^{18}$ pieces/cm$^3$ to $2\times10^{21}$ pieces/cm$^3$ and N having the number of atoms ranging from $1\times10^{18}$ pieces/cm$^3$ to $8\times10^{21}$ pieces/cm$^3$. The foregoing distribution of the number of atoms allows shortening the discharge-delay time as well as suppressing a change of the discharge-delay with respect to a temperature.

Presence of the foregoing concentration in a place between the upper most surface of protective layer 10 and a depth of 200 nm in thickness direction allows achieving the advantage discussed above.

Exemplary Embodiment 2

In the previous embodiment, an MgO-sintered body and powder of $Si_3N_4$ are mixed together to be evaporation material. Use of another evaporation material formed of other ingredients allows protective layer 10 to contain Si and N. For instance, an MgO-sintered body, powder of Si and powder of nitride are mixed together, then they are sintered to be evaporation material. Use of this material as evaporation source allows obtaining protective layer 10 that contains Si and N. An instance of the nitride is aluminum nitride (AMN), boron nitride (BN). Power of silicon dioxide ($SiO_2$) can be used instead of powder of Si.

In the case of using the foregoing material as the evaporation source, an amount of Si powder (or $SiO_2$ powder) and an amount of nitride powder are adjusted independently, so that the concentration of Si or N in protective layer 10 can be controlled independently. As shown in the first embodiment, in the case of using protective layer 10 that includes Si having the number of atoms ranging from $5\times10^{18}$ pieces/cm$^3$ to $2\times10^{21}$ pieces/cm$^3$ and N having the number of atoms ranging from $1\times10^{18}$ pieces/cm$^3$ to $8\times10^{21}$ pieces/cm$^3$, an amount of Si powder (or $SiO_2$ powder) and an amount of nitride powder to be mixed in the evaporation material are shown in table 1 and table 2 respectively.

TABLE 1

| Concentration of Si (pieces/cm$^3$) | | $5.0\times10^{18}$ | — | $2.0\times10^{21}$ |
|---|---|---|---|---|
| Additive concentration to evaporation source (weight ppm) | Si powder | 7 | — | 8000 |
| | $SiO_2$ powder | 14 | — | 17200 |

TABLE 2

| Concentration of N (pieces/cm$^3$) | | $1.0\times10^{18}$ | — | $8.0\times10^{21}$ |
|---|---|---|---|---|
| Additive concentration to evaporation source (weight ppm) | AlN powder | 10 | — | 17600 |
| | BN powder | 7 | — | 10700 |

As shown in table 1, the additive concentration of Si powder is set at 7 weight ppm-8000 weight ppm ($SiO_2$ powder at 14 weight ppm-17200 weight ppm), so that the concentration of Si in protective layer 10 can fall within a range approx. from $5\times10^{18}$ pieces/cm$^3$ to $2\times10^{21}$ pieces/cm$^3$. As shown in table 2, the additive concentration of AlN powder is set at 10 weight ppm-17600 weight ppm (BN powder at 7-10700 weight ppm), so that the concentration of N in protective layer 10 can fall within a range approx. from $1\times10^{18}$ pieces/cm$^3$ to $8\times10^{21}$ pieces/cm$^3$. An evaporation source, to which $SiO_2$ powder of 14 weight ppm-17200 weight ppm is added, contains Si of approx. 7 weight ppm-8000 weight ppm. An evaporation source, to which AlN powder of 10 weight ppm-17600 weight ppm is added, contains N of approx. 4-6000 weight ppm. An evaporation source, to which BN of 7-10700 weight ppm is added, contains N of approx. 4-6000 weight ppm.

A method of manufacturing the evaporation material to be used as the evaporation source is to mix a crystalline body or sintered body of MgO with the powders listed in table 1 and table 2, or to mix MgO powder as base material with the powders listed in table 1 and table 2, then the mixed material is sintered.

As the previous discussion proves that inclusive of Si and N in protective layer 10 of a PDP allows shortening a discharge-delay time as well as lowering dependence of the discharge-delay time on a temperature. Use of protective layer 10 made of MgO, which layer 10 contains Si having the number of atoms ranging from $5\times10^{18}$ pieces/cm$^3$ to $2\times10^{21}$ pieces/cm$^3$ and N having the number of atoms ranging from $1\times10^{18}$ pieces/cm$^3$ to $8\times10^{21}$ pieces/cm$^3$, allows the PDP to display a video without changing a voltage conventionally set. As a result, the temperature-dependence of discharge-delay time can be lowered. Protective layer 10 made of the foregoing MgO can be formed by using MgO which contains Si and N having the concentrations falling within the following ranges:

Si: 7-8000 weight ppm, and

N: 4-6000 weight ppm.

The factor of lowering the temperature-dependence of discharge-delay time is still before explicit description; however, it can be presumed that the additive of not only Si but also N to MgO can eliminate a factor which makes the discharge-delay time depend heavily on a temperature.

An evaporation method is taken as an example of the method of manufacturing the protective layer; however, the method is not limited to the evaporation method, and a sputtering or ion-plating method can be used instead. In such a case, ingredients of the target material and the base material are selected appropriately for forming a film.

During the process for forming a film of the protective layer, an element can be added, for instance, a gas containing Si and N can be used as an atmospheric gas when the protective layer is formed by the evaporation method.

INDUSTRIAL APPLICABILITY

The present invention achieves excellent response of discharge to a voltage application with a shorter discharge-delay time, and lowers the dependence of the discharge-delay time on a temperature. As a result, the PDP that can display a quality video is obtainable.

The invention claimed is:

1. A plasma display panel (PDP) adopting an AC surface discharge method comprising:

forming a front panel including:

a scan electrode and a sustain electrode both formed on a plate and to which a voltage is applied in order to generate discharge;

a dielectric layer covering the scan electrode and the sustain electrode; and a protective layer formed on the dielectric layer, and forming a back panel including:

an electrode protective layer covering an address electrode formed on a plate;

a barrier rib formed on the electrode protective layer; and a phosphor layer provided between the barrier rib, wherein the front panel and the back panel are arranged to oppose each other, and circumference thereof is sealed together so as to form a discharge space therebetween, and wherein the protective layer on the dielectric layer is made of magnesium oxide (MgO) including silicon (Si) of which atoms count in a range from $5\times10^{18}$ pieces/cm$^3$ to $2\times10^{21}$ pieces/cm$^3$ and nitrogen (N) of which atoms count in a range from $1\times10^{18}$ pieces/cm$^3$ to $8\times10^{21}$ pieces/cm$^3$.

2. A method of manufacturing a plasma display panel (PDP) adopting an AC surface discharge method, the method comprising the steps of:

forming a front panel including:

a scan electrode and a sustain electrode both formed on a plate and to which a voltage is applied in order to generate discharge;

a dielectric layer covering the scan electrode and the sustain electrode; and a protective layer formed on the dielectric layer; and forming a back panel including:

an electrode protective layer covering an address electrode formed on a plate;

a barrier rib formed on the electrode protective layer; and a phosphor layer provided between the barrier rib, wherein the front panel and the back panel are arranged to oppose each other, and circumference thereof is sealed together so as to form a discharge space therebetween, wherein forming the protective layer on the dielectric layer includes a process for forming a film that uses material of the protective layer, which material is made of magnesium oxide (MgO) including silicon (Si) and nitrogen (N), and wherein a concentration of the Si falls within a range from 7 weight ppm to 8000 weight ppm, and a concentration of the N falls within a range from 4 weight ppm to 6000 weight ppm.

3. A method of manufacturing a PDP adopting an AC surface discharge method, the method comprising the steps of:

forming a front panel including:

a scan electrode and a sustain electrode both formed on a plate and to which a voltage is applied in order to generate discharge;

a dielectric layer covering the scan electrode and the sustain electrode; and a protective layer formed on the dielectric layer; and forming a back panel including:

an electrode protective layer covering an address electrode formed on a plate;

a barrier rib formed on the electrode protective layer; and a phosphor layer provided between the barrier rib, wherein the front panel and the back panel are arranged to oppose each other, and circumference thereof is sealed together so as to form a discharae space therebetween, and wherein forming the protective layer on the dielectric layer includes a process for forming a film that uses material of the protective layer, which the material is made of magnesium oxide (MgO) including silicon nitride ($Si_3N_4$) of which concentration falls within a range from 10 weight ppm to 15000 weight ppm.

4. Material of a protective layer of a plasma display panel adopting an AC surface discharge method, the plasma display panel comprising a front panel including scan electrode and a sustain electrode both formed on a plate and to which a voltage is applied in order to generate discharge; a dielectric layer covering the scan electrode and the sustain electrode; and a protective layer formed on the dielectric layer, and a back panel including: an electrode protective layer covering an address electrode formed on a plate; a barrier rib formed on the electrode protective layer, and a phospher layer provided between the barrier rib, wherein the front panel and the back panel are arranged to oppose each other, and circumference thereof is sealed together so as to form a discharge space therebetween.

wherein the material is made of magnesium oxide (MgO) including Si and N, wherein a concentration of the Si falls within a range from 7 weight ppm to 8000 weight ppm, and a concentration of the N falls within a range from 4 weight ppm to 6000 weight ppm.

5. Material of a protective layer of a plasma display panel adopting an AC surface discharge method, the plasma display panel comprising a front panel including a scan electrode and a sustain electrode both formed on a plate and to which a voltage is applied in order to generate discharge; a dielectric layer covering the scan electrode and the sustain electrode; and a protective layer formed on the dielectric layer, and a back panel including: an electrode protective layer covering an address electrode formed on a plate; a barrier rib formed on the electrode protective layer; and a phosphor layer provided between the barrier rib, wherein the front panel and the back panel are arranged to oppose each other and circumference thereof is sealed together so as to form a discharge space therebetween, and wherein the material is made of magnesium oxide (MgO) including silicon nitride ($Si_3N_4$) of which concentration falls within a range from 10 weight ppm to 15000 weight ppm.

* * * * *